US007303095B2

(12) United States Patent
Nagelski et al.

(10) Patent No.: US 7,303,095 B2
(45) Date of Patent: Dec. 4, 2007

(54) MERCHANDISE DISPENSER WITH TIME DELAY

(75) Inventors: Keith C. Nagelski, Huntersville, NC (US); Christopher J. Fawcett, Charlotte, NC (US); Ronald M. Marsilio, Lake Wiley, SC (US)

(73) Assignee: Alpha Security Products, Inc., Charlotte, NC (US)

( * ) Notice: Subject to any disclaimer, the term of this patent is extended or adjusted under 35 U.S.C. 154(b) by 45 days.

(21) Appl. No.: 11/018,818

(22) Filed: Dec. 21, 2004

(65) Prior Publication Data

US 2006/0131320 A1 Jun. 22, 2006

(51) Int. Cl.
*B65G 59/00* (2006.01)
*B65H 3/00* (2006.01)

(52) U.S. Cl. ..... 221/256; 221/269; 221/3

(58) Field of Classification Search ..... 221/277, 221/276, 268, 265, 263, 256, 255, 208, 3, 221/67, 175, 289, 193, 312 R, 130, 131, 221/109, 281, 194, 154, 151, 68, 266; 211/59.2; 194/57, 59; 193/38

See application file for complete search history.

(56) References Cited

U.S. PATENT DOCUMENTS

| | | | | | |
|---|---|---|---|---|---|
| 2,071,771 | A * | 2/1937 | Shield | 53/168 |
| 2,711,241 | A * | 6/1955 | Abrahamsen | 193/38 |
| 4,146,122 | A * | 3/1979 | Harris | 194/253 |
| 4,712,712 | A * | 12/1987 | Garden | 221/68 |
| 4,887,737 | A * | 12/1989 | Adenau | 221/3 |
| 5,462,198 | A * | 10/1995 | Schwimmer | 221/130 |
| 5,743,605 | A * | 4/1998 | Marino | 312/211 |
| 6,206,237 | B1 * | 3/2001 | Dillon et al. | 221/289 |
| 6,793,097 | B2 * | 9/2004 | Kamenstein | 221/33 |

* cited by examiner

*Primary Examiner*—Gene Crawford
*Assistant Examiner*—Timothy Waggoner
(74) *Attorney, Agent, or Firm*—Sand & Sebolt

(57) ABSTRACT

A dispenser for items of merchandise is formed as a wire rack having an entrance opening for placing the items into the dispenser and a discharge opening for removal of the items from the dispenser by a customer. A pivotally moveable gate located adjacent the discharge opening permits removal of the items one at a time, with a time delay being required between the removal of each of the items to retard shoplifting. The gate also produces an audible sound when moving toward the open position to further reduce possible shoplifting.

20 Claims, 10 Drawing Sheets

MERCHANDISE DISPENSER WITH TIME DELAY

BACKGROUND OF THE INVENTION

1. Technical Field

The invention relates to dispensing systems and in particular to a dispenser for dispensing items of merchandise one item at a time with a time delay between the individual dispensing of the items to prevent rapid removal of a plurality of the items from the dispenser by a potential shoplifter.

2. Background Information

It is desirable in retail establishments such as supermarkets and large volume discount stores, to display a plurality of items in racks in order to provide a sufficient supply of the item for the customers and to avoid constant restocking of the item throughout a business day. However, this presents a problem for certain items of merchandise which are subject to shoplifting wherein an individual will rapidly remove a number of the items from the display rack and place the same in a concealed location or run from the store without paying for the selected items.

Various devices have been devised to prevent the loss of merchandise such as the placement of EAS tags on the items, securing the items in a locked cabinet or dispenser, all of which increases the cost of doing business and delay in checking the customer out at a checkout location. Also, this inconveniences the customer, possibly resulting in loss of goodwill and even the customer to a competitor store.

For certain items which may be susceptible to shoplifting, especially relatively expensive food products, such as baby formula, it is believed that theft may be reduced by placing the items in a dispenser which enables the customer to remove the item from the dispenser or display rack, but prevent rapid removal of the product. However it is desirable that a prospective customer be able to view the containers of the item when in a stored position in the dispenser and to read the information printed on the containers prior to removing the same from their stored position.

Thus, the need exists for an improved dispenser for items of merchandise, such as cylindrical containers for various food products, which prevents a customer from removing a plurality of the items from a display rack in rapid succession, while permitting the items to be dispensed one at a time with a time delay between the dispensing of the individual items.

BRIEF SUMMARY OF THE INVENTION

One feature of the invention is to provide a dispenser for various items of merchandise, such as cylindrical containers, in a rack formed by a plurality of spaced wires which enable a perspective purchaser to view the containers when in a stored position and read the label and instructions on the container prior to removing the same from the dispenser.

Another aspect of the invention is to provide a dispenser with a moveable gate which when moved to an open position enables one item to be removed from the dispenser while blocking the adjacent item from being removed until the gate has returned to a closed position, thus, preventing the rapid removal of a plurality of items from the dispenser at one time.

Still another feature of the invention is to provide a dispenser in which the dispensing gate produces an audible sound when moved toward the open position which could alert store personnel if a number of items were removed in rapid succession by immediately opening and closing and then re-opening and closing the access door.

Another aspect of the invention is to enable display material to be placed conveniently on the dispenser advising the customer of the product stored therein as well as the price and other information relating thereto by means of a placard located at the entrance opening of the dispenser.

A further aspect of the invention is to provide a dispenser which has an entrance opening through which the containers are inserted and stacked in the storage rack and which pass by a one-way flexible member which prevents the stored items from being removed from the entrance opening once inserted therein, requiring that the item be removed from the controlled discharge opening thereof.

A still further feature of the invention is to provide such a dispenser which is formed relatively inexpensive of rigid wire members, which provide an attractive display for the merchandise contained therein, and which reduces the possibility of the shoplifting of a plurality of the items from the dispenser by providing a time delay and audible signal that an item is being dispensed.

These features are obtained by the improved dispenser of the present invention the general nature of which comprises a housing for storing a plurality of the items, the housing having an entrance opening and a discharge opening for placing and removing the items into and from the housing; a gate moveably mounted at the discharge opening permitting removal of only one of the items at a time from the housing, the gate being moveable between a first position across at least a portion of the discharge opening preventing removal of any of the items from the housing and a second position permitting removal of one of the items proximate the discharge opening and blocking removal of the other of the items from the housing until the gate has returned to the first position.

BRIEF DESCRIPTION OF THE DRAWINGS

A preferred embodiment of the invention, illustrative of the best mode in which applicant contemplates applying the principle, is set forth in the following description and is shown in the drawings, and is particularly and distinctly pointed out and set forth in the appended claims.

Similar numerals refer to similar parts throughout the drawings.

DETAILED DESCRIPTION OF THE INVENTION

Figure 1:
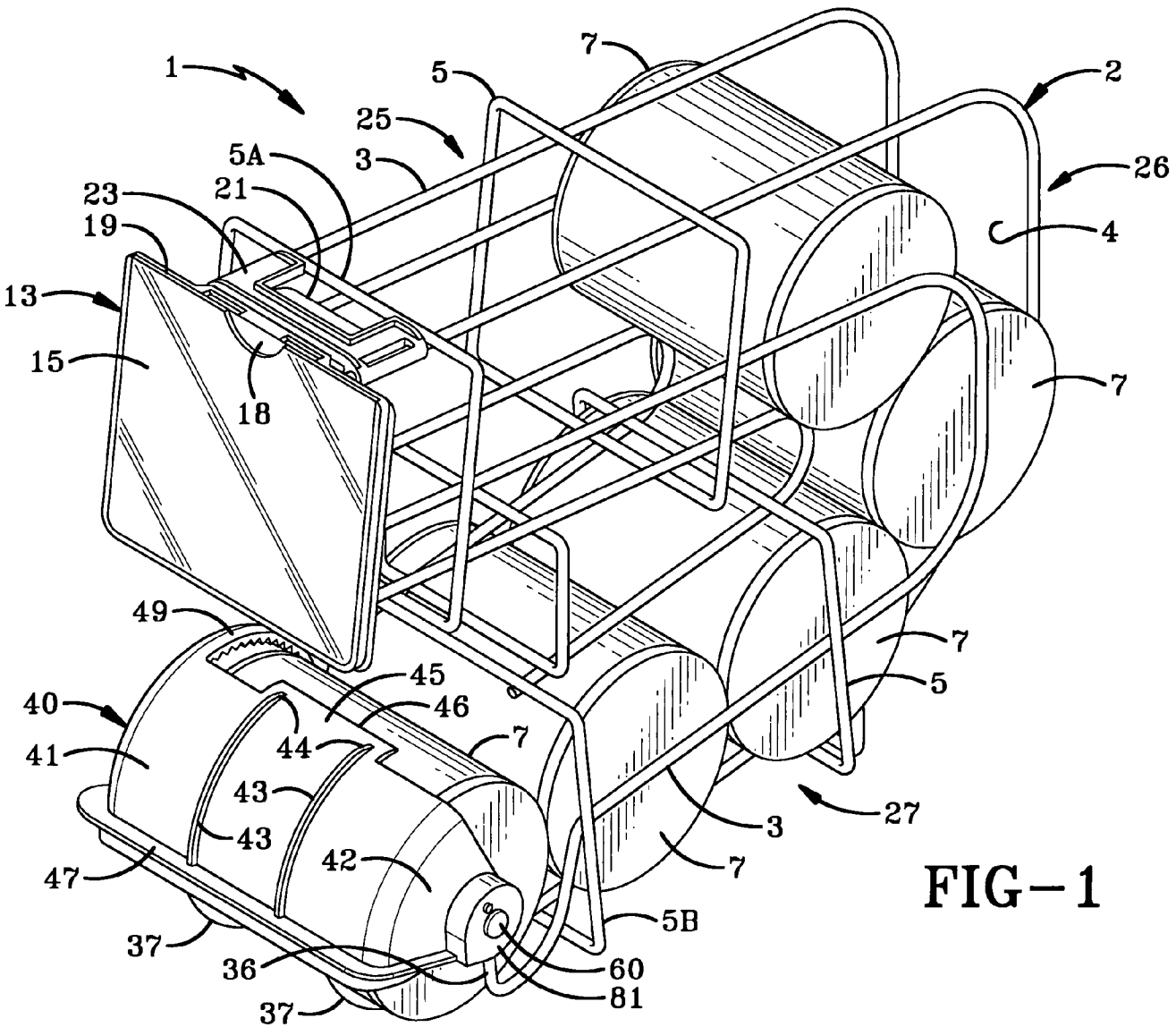
FIG. 1 is a perspective view of the merchandise dispenser of the present invention containing a plurality of cylindrical merchandise with the gate in a closed position.
Figure 2:
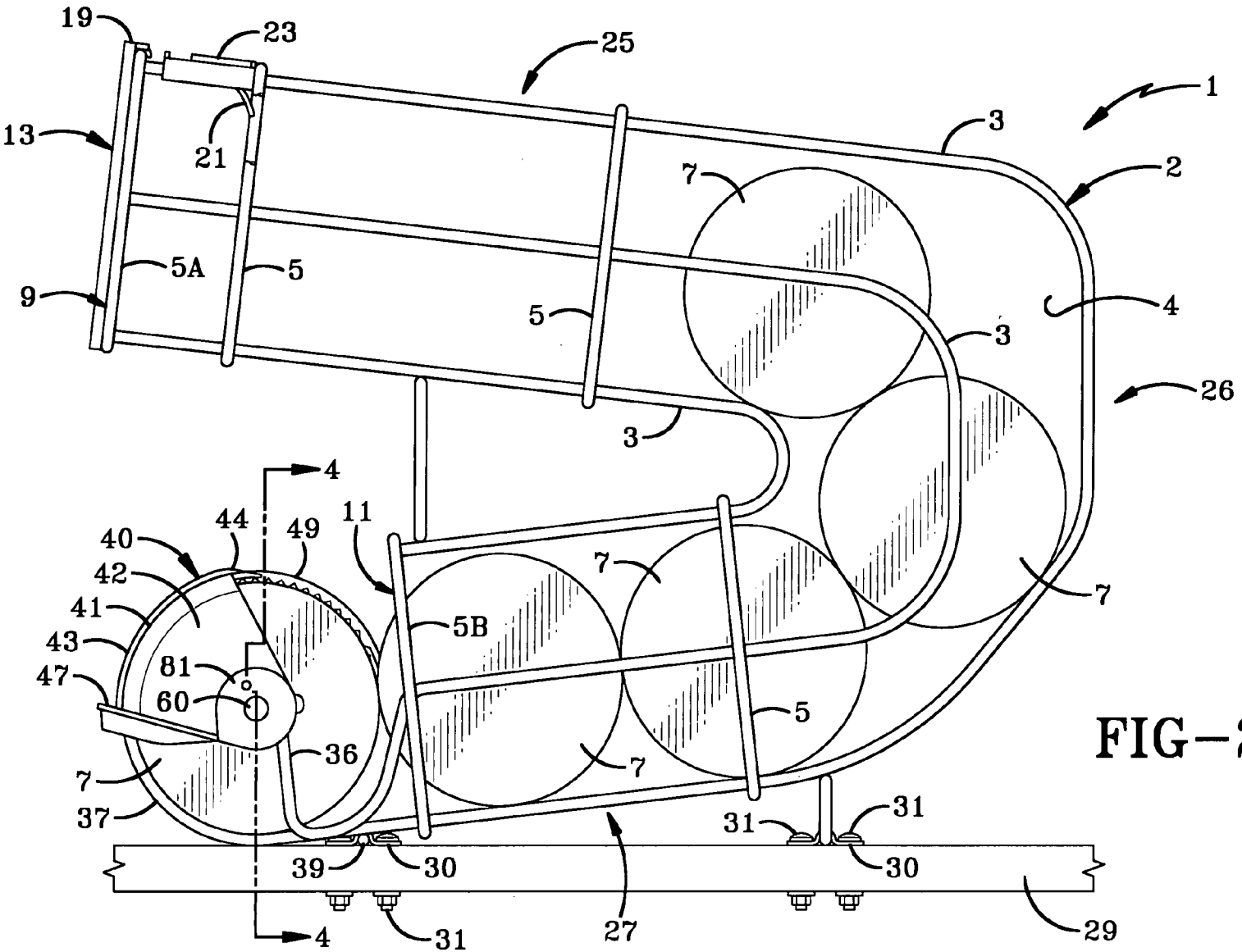
FIG. 2 is a side elevational view of a FIG. 1.

The merchandise dispenser of the present invention is indicated generally at 1 and is shown in assembled operating condition in FIGS. 1 and 2. Dispenser 1 includes a main housing 2 formed of a plurality of U-shaped spaced wires indicated collectively at 3, secured together by a plurality of spaced rectangular shaped wire frames 5. The wires are rigid and stiff enough to maintain the flattened U-shaped configuration of housing 2 as shown in FIG. 2, and strong enough to support and receive a plurality of items of merchandise therein, such as indicated by cylindrical containers 7. Housing 2 includes a generally flattened U-shaped internal item storage chamber 4 having an entrance opening 9 and a discharge opening 11. Opening entrance 9 is defined by a rectangular wire frame 5A and discharge opening is defined by a rectangular wire frame 5B.

Figure 3:
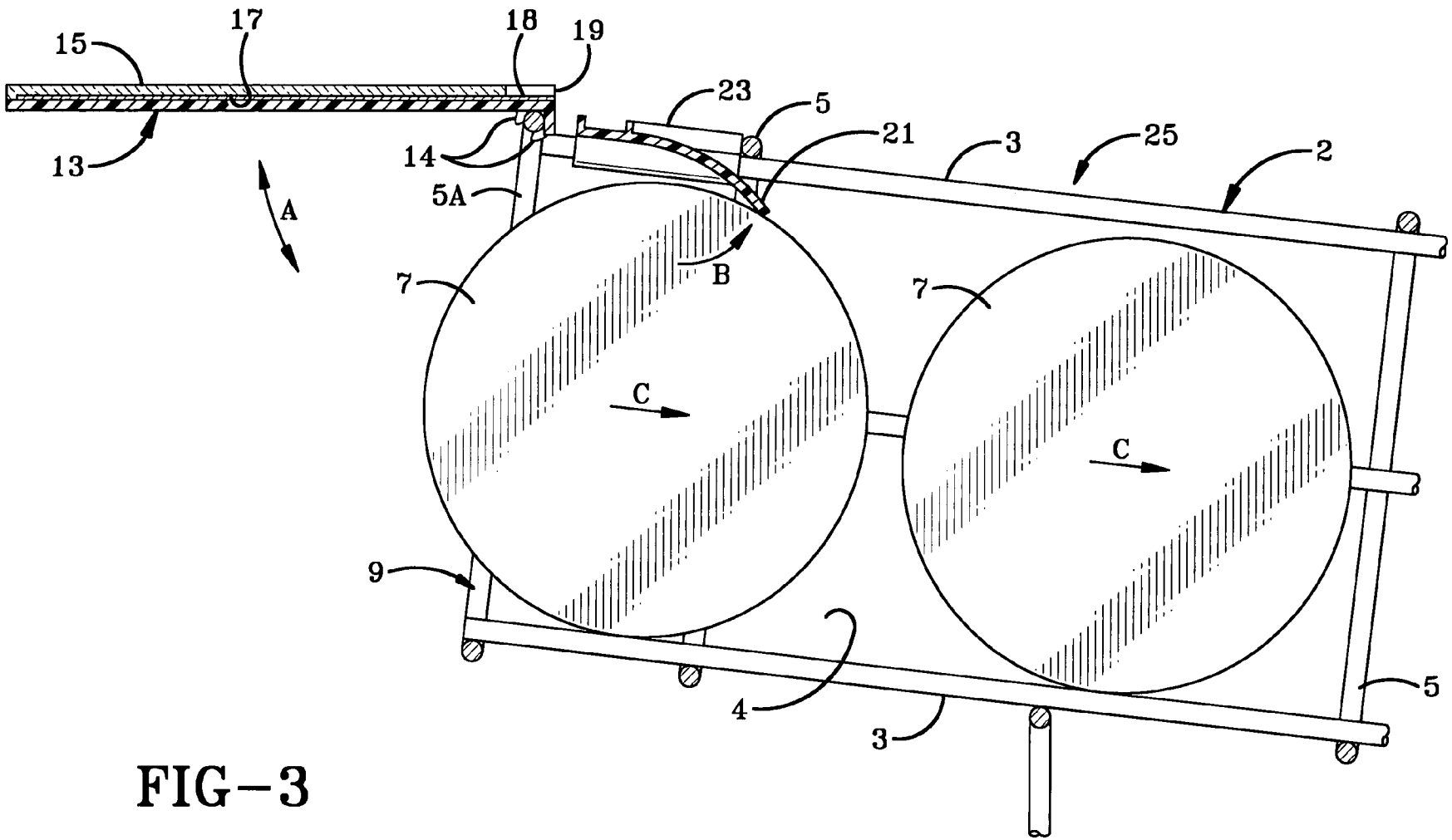
FIG. 3 is an enlarged fragmentary view with portions in section, of the entrance end of the dispenser with the door in an open position.

A closure door indicated generally at 13, is pivotally mounted on frame member 5A (FIG. 3) by a pair of curved flanges 14 and is moveable between open and closed positions as shown arrow A. In accordance with one of the features of the invention, a transparent panel 15 is attached to door 13 and forms a internal pocket 17 for receiving printed indicia 18 therein which provides information regarding the product contained in dispenser 1, such as the price, product description, etc. Indicia 18 is easily replaced in pocket 17 by sliding it through an open top 19 thereof.

In accordance with another feature of the invention, a flexible one-way retaining clip 21 (FIG. 3) is mounted inwardly of entrance opening 9 by a clip 23 and is sufficiently flexible to enable merchandise containers 7 to move clip 21 out of the way as shown by arrow B, as they are being placed through entrance 9 and into the storage chamber 4 as shown by arrows C. After passage of a container 7, retaining clip 21 will return to its at-rest position as shown in FIG. 2, which will prevent the removal of container 7 through entrance opening 9. It is easily seen in FIG. 2 that item 7 will roll along chamber 4 due to the downwardly sloped direction of an upper portion 25 of housing 2 and around a curved web portion 26 and then along a downwardly dispenser portion 27 to adjacent discharge opening 11. Dispenser 1 preferably is secured to a support surface 29 by a plurality of brackets 30 and fasteners 31. This prevents removal of the entire dispenser by a potential shoplifter as well as excess bending or movement of the housing.

Figure 10:
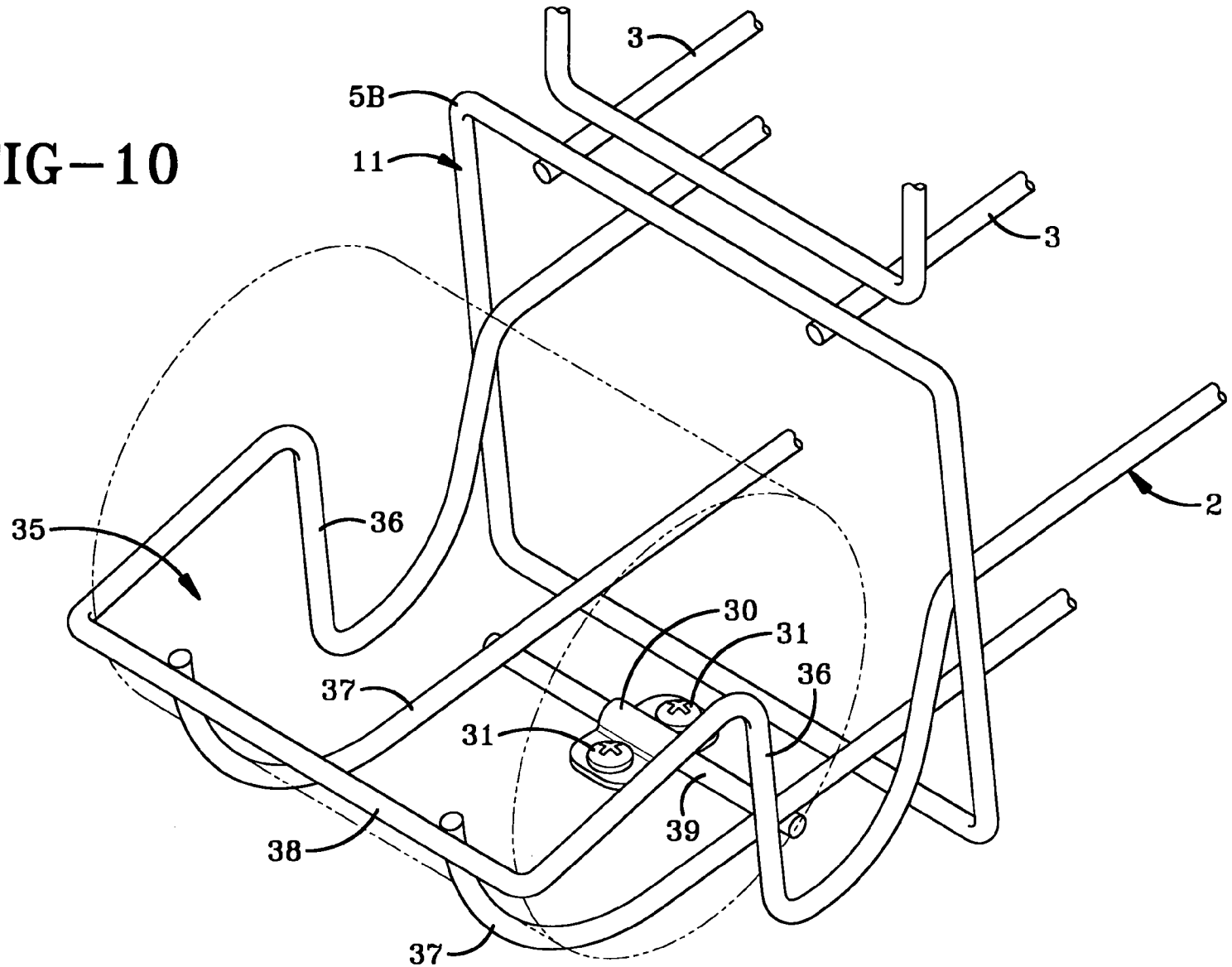
FIG. 10 is a fragmentary perspective view of the front receptacle portion of the dispenser.

In accordance with still another feature of the invention, a item receiving receptacle, indicated generally at 35 (FIG. 10), is formed adjacent to and in communication with discharge opening 11 by a pair of spaced parallel curved wires 36, a pair of spaced parallel bottom supporting wires 37, an end cross wire 38 and an attachment wire 39. Receptacle 35 is adapted to receive a merchandise container 7 as it rolls through discharge opening 11 where it is trapped and retained in the receptacle by a gate indicated generally at 40. Receptacle 35 has a generally semi cylindrical configuration and is sized to receive only one of the items 7 at a time.

Figure 4:
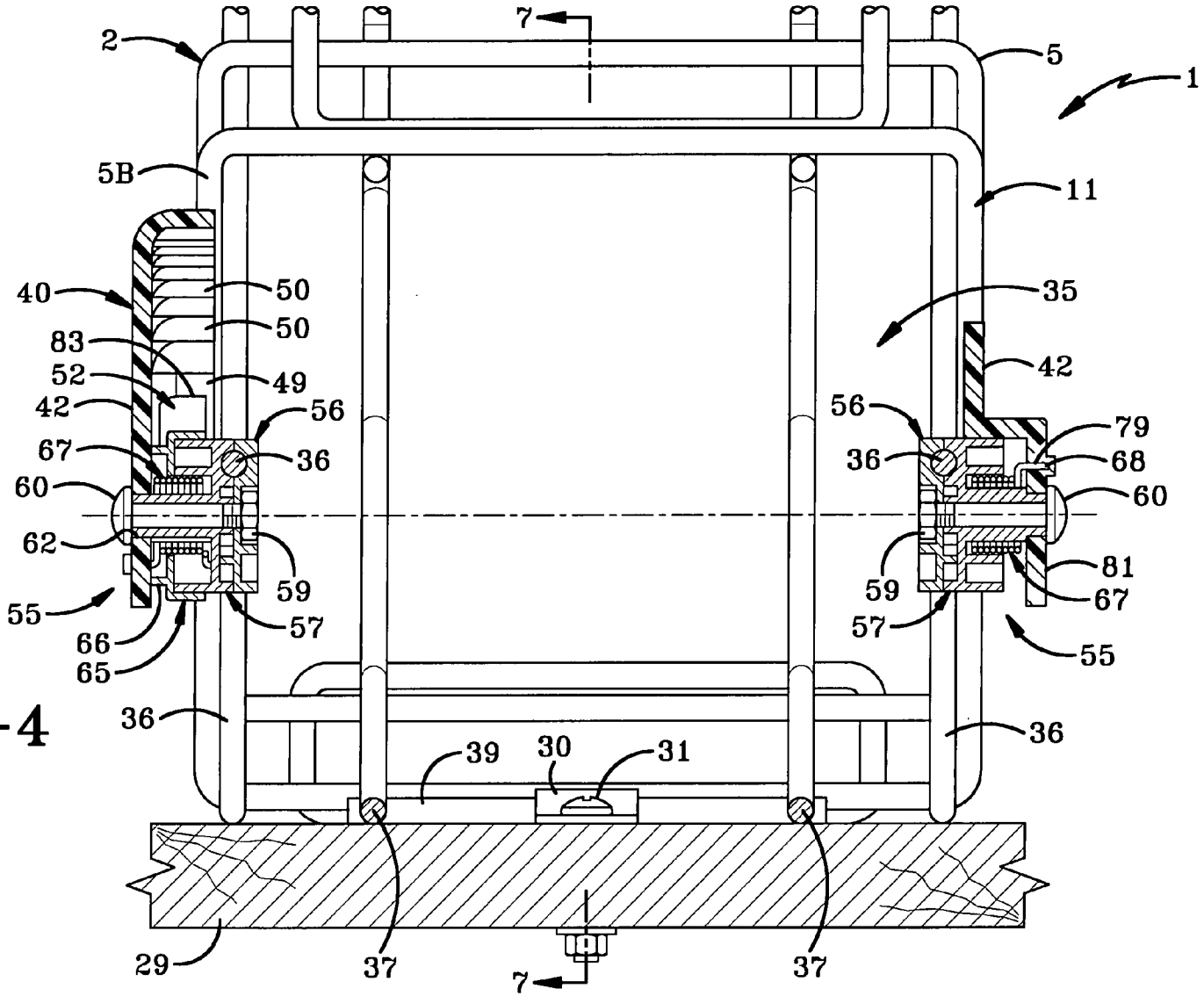
FIG. 4 is an enlarged sectional view taken along line 4-4, FIG. 2.
Figure 7:
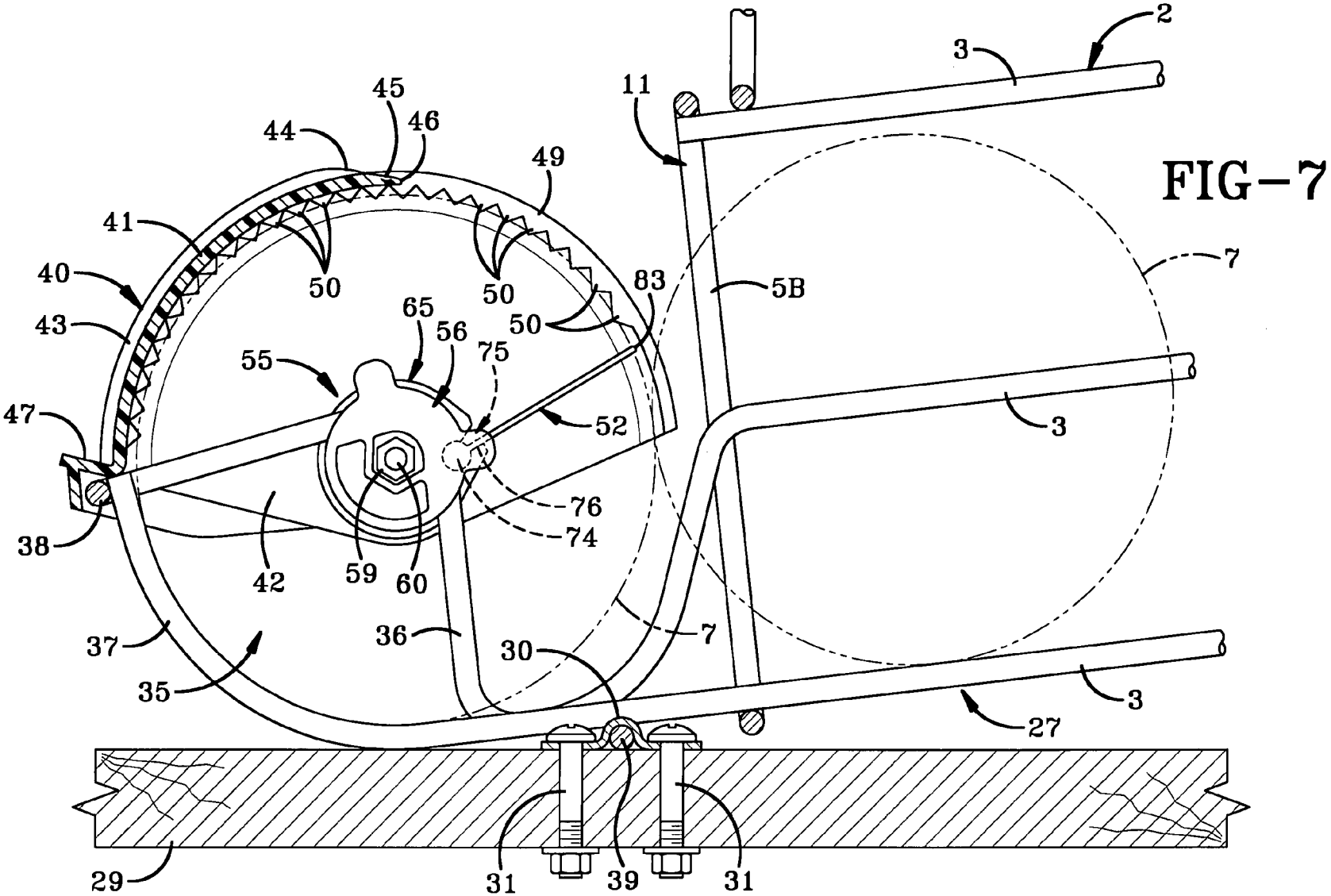
FIG. 7 is a fragmentary side elevational view with portions broken away, showing the gate in a closed position.
Figure 8:
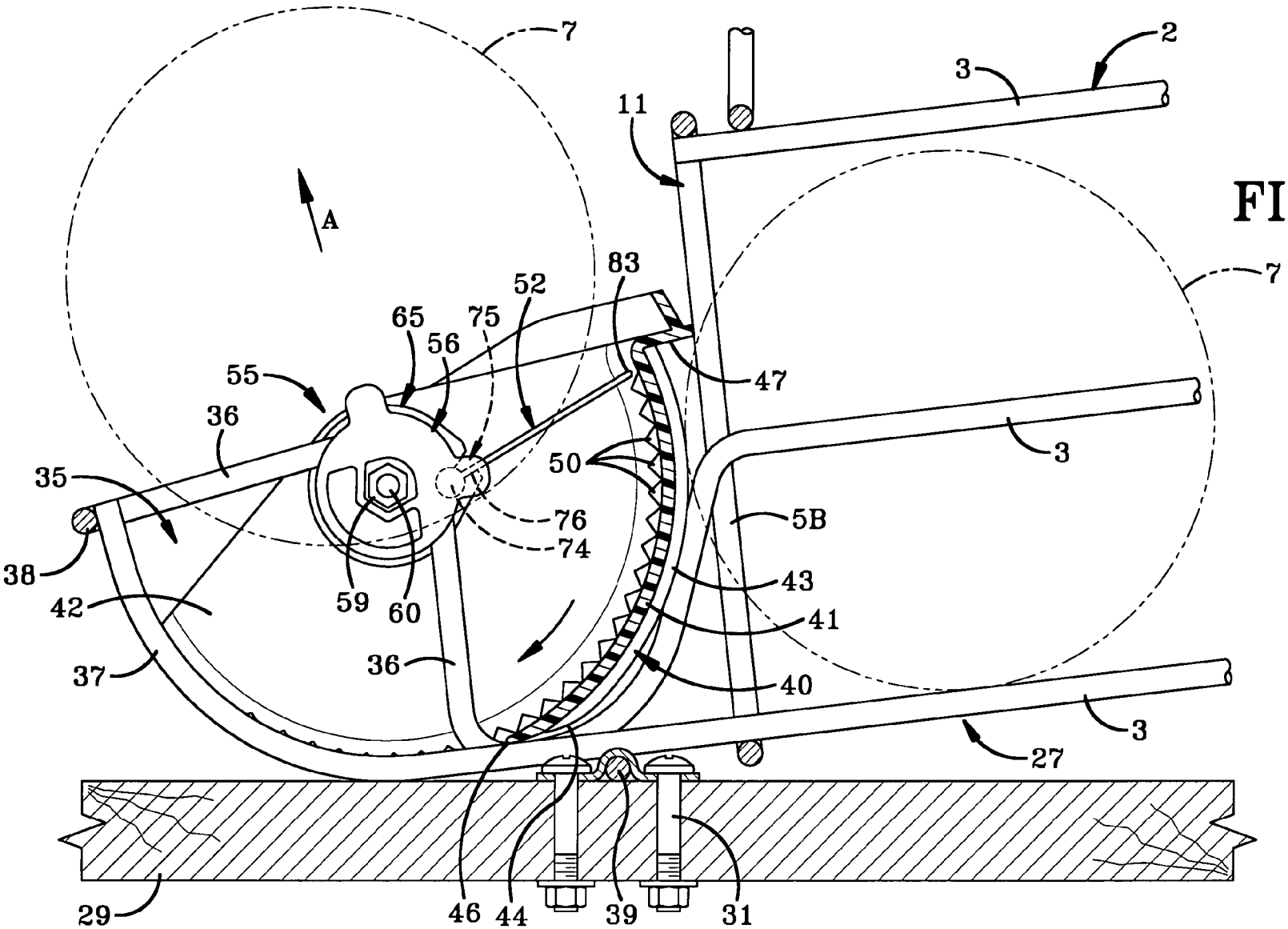
FIG. 8 is a view similar to FIG. 7 with the gate being shown in an open position.
Figure 9:
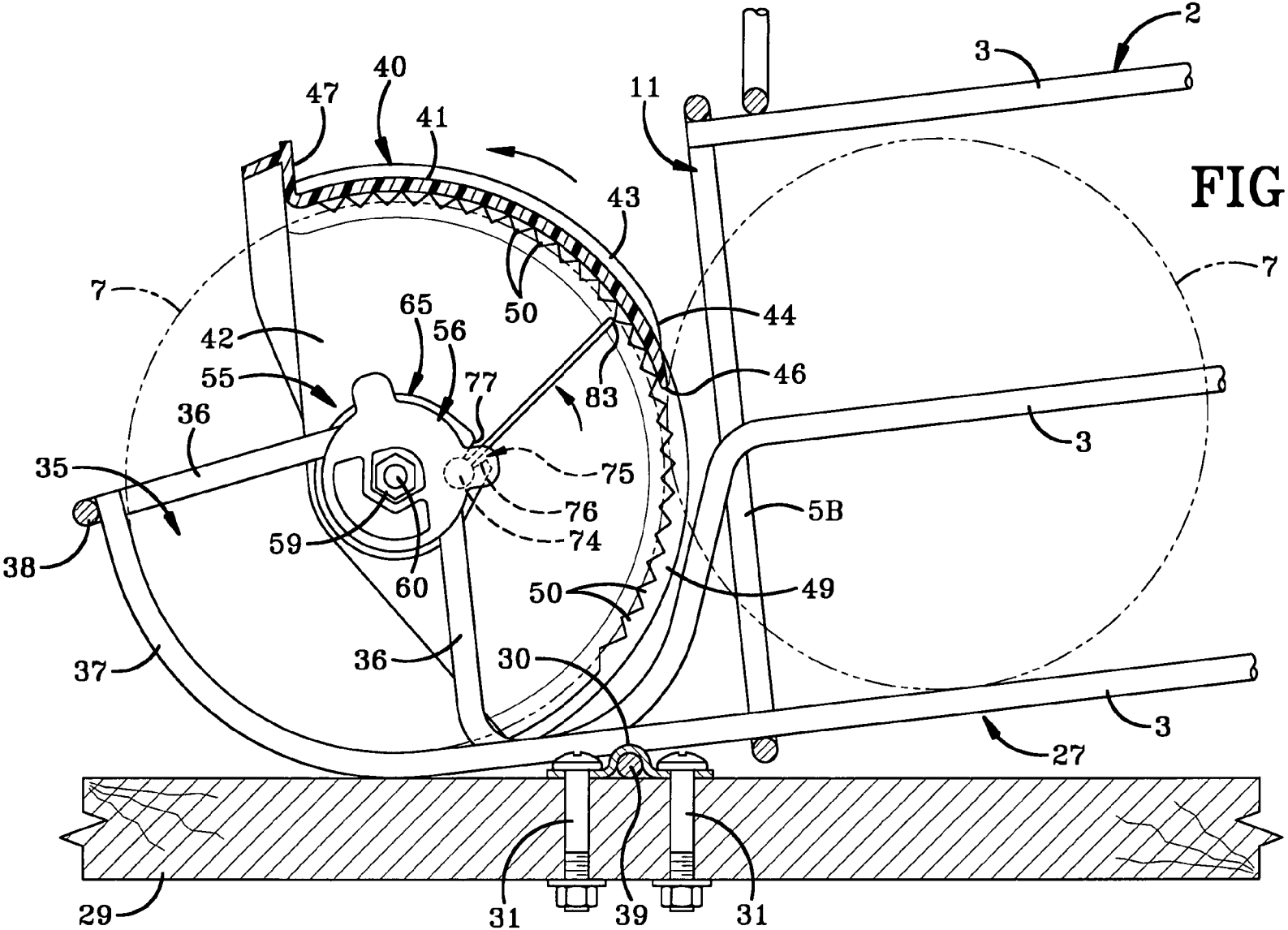
FIG. 9 is a view similar to FIG. 7 and FIG. 8 showing the gate moving from the open position of FIG. 8 to the closed position of FIG. 7.

Gate 40 preferably is a one piece member formed of plastic or metal material and includes an arcuate shaped front wall 41 and a pair of segmental shaped side walls 42. A pair of spaced ribs 43 are formed on and extend along front wall 41 and terminate in tapered ends 44 which are located within an elongated tab portion 45 thereof. Tab portion 45 also terminates in a tapered edge 46 as shown in FIG. 7. The function of these components are discussed further below. A lifting ledge 47 is formed on and extends outwardly from front wall 41 and side walls 42 and provides the area which a customer will grasp to move the gate from a closed position as shown in FIGS. 1, 2 and 4 to an open position as shown in FIG. 8. Lifting ledge 47 also provides additional ridgity to gate 40. Gate 40 further includes an arcuately extending portion 49 (FIGS. 1, 2 and 4) extending beyond one side wall 42 thereof. Arcuate extension 49 extends throughout an arc slightly less than 180° and is formed with a plurality of teeth 50 which are adapted to engage a flexible finger 52 to produce an audible noise as gate 40 is moved from a closed position of FIG. 7 toward the open position of FIG. 8.

Figure 5:
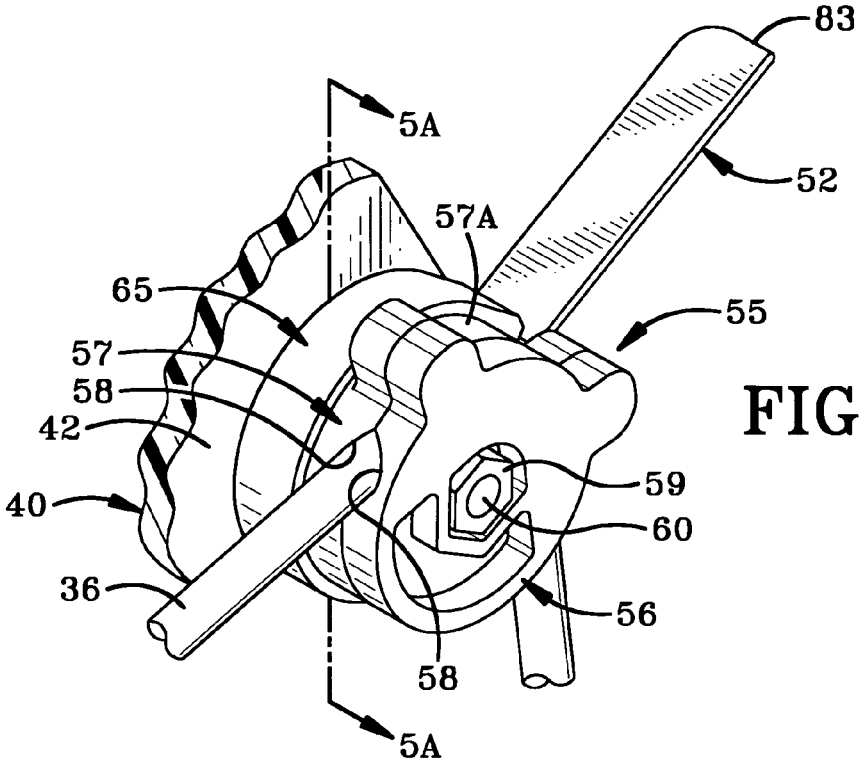
FIG. 5 is a perspective view of the left-hand pivot assembly of FIG. 4.
Figure 5A:
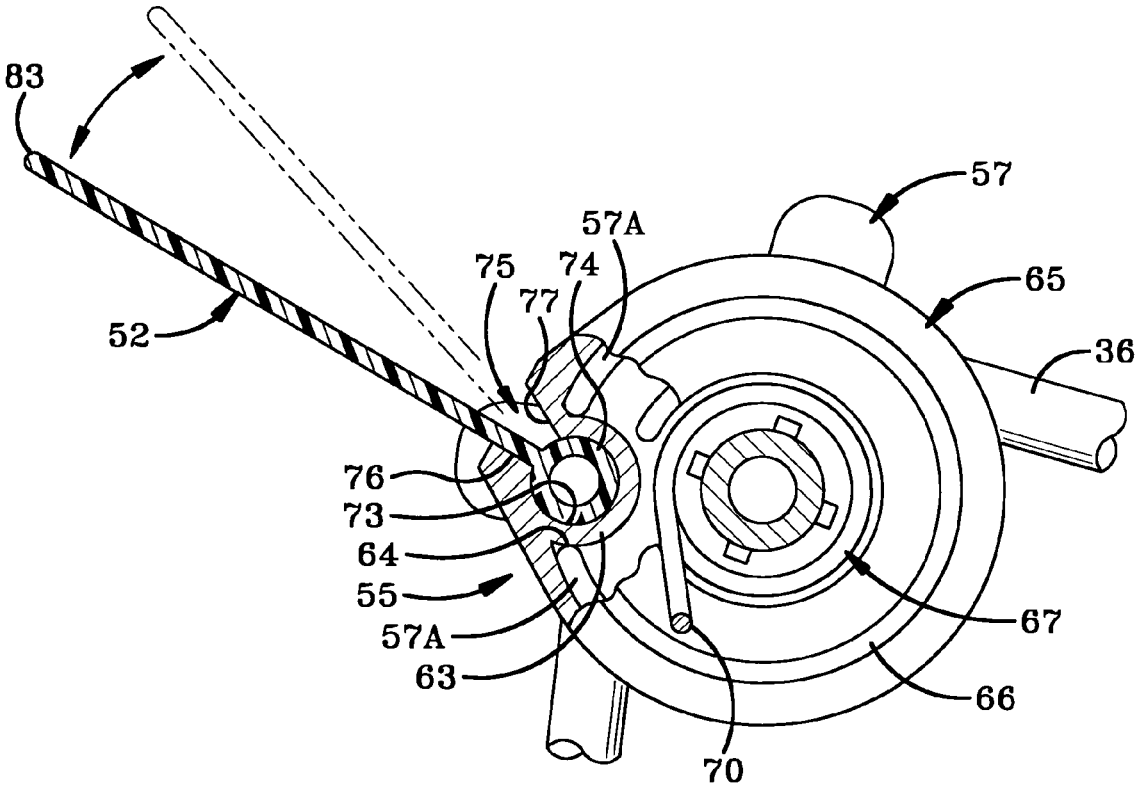
FIG. 5A is a sectioned view taken on line 5A-5A of FIG. 5.
Figure 6:
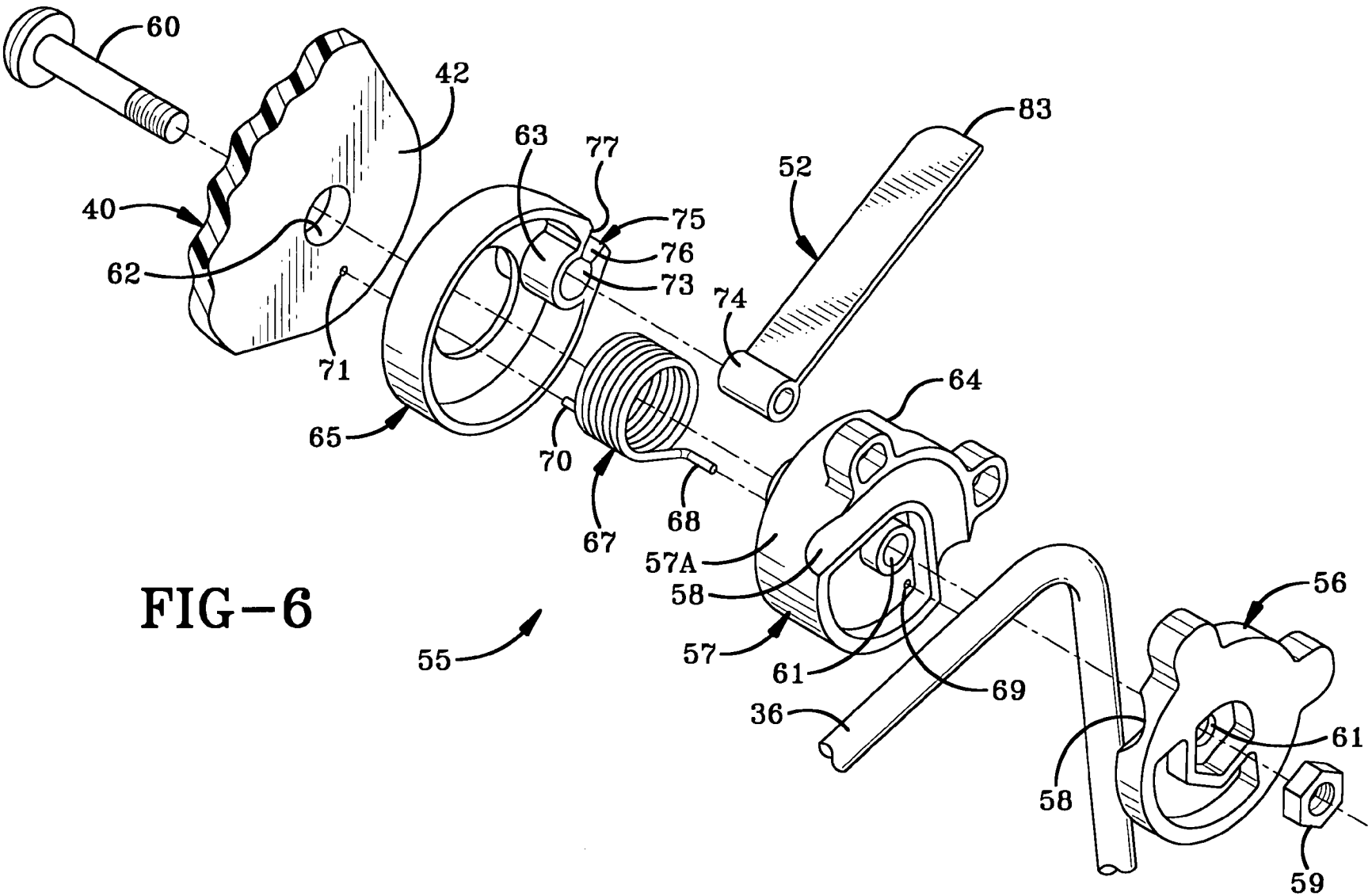
FIG. 6 is an exploded perspective view of the pivot assembly of FIG. 5.

Gate 40 is pivotally mounted on spaced wires 36 of receptacle 35 by a pair of pivot assemblies, each of which is indicated generally at 55 (FIGS. 5, 5A and 6). Each pivot assembly includes a pair of hubs 56 and 57, which are formed with L-shaped grooves 58 for receiving wires 36 therein. Hubs 56 and 57 are clamped tightly together about rod 36 and are immoveable with respect thereto due to the shape of wire 36, by a nut 59 and bolt 60. Bolt 60 extends through aligned holes 61 in the hubs and formed through an aligned holes 62 formed in side walls 42 of gate 40. One of the pivot assemblies, shown on the left side of FIG. 4, includes an end cap 65 (FIG. 6), which is slidably mounted over a portion of adjacent hub 57 and traps a coil spring 67 therebetween. Spring 67 has a bent end 68 that extends into a hole 69 formed in hub 57 and has another bent end 70, which extends through a hole 71 formed in side wall 42 of gate 40 to secure spring 67 in a fixed position on the dispenser for biasing gate 40 toward the closed position of FIG. 7.

End cap 65 is formed with a generally rounded small internal wall 63 which forms a circular recess 73 (FIG. 6) in which is mounted a rolled end 74 of flexible finger 52. Recess 73 connects with an angled channel 75 formed by a pair of side wall surfaces 76 and 77. The right side pivot assembly 55 of FIG. 4, is very similar to that of the left side pivot assembly as shown in FIGS. 5, 5A and 6 with the exception that it does not contain a sound producing finger 52 and end cap 65 for mounting the finger therein. End cap 65 preferably is formed with an annular rib 66 which slidably engages the inside surface of gate side wall 42 as shown particularly in FIG. 4. End cap 65 in fixedly mounted with respect to hub 57 by wall 63 of recess 73 being seated within an opening 64 formed in hub end wall 57A (FIGS. 5A and 6). The right side pivot assembly 55 of FIG. 4, preferably includes a coil spring 67 with bent end 68 extending into a hole 79 formed in a hub portion 81 of side wall 42 to assist in biasing gate 40 toward the closed position.

Thus, pivot assemblies 55 are mounted in a fixed position on wires 36 of receptacle 35 by bolt 60 or other type of fastener, and rotatably mount gate 40 thereon, and bias gate 40 toward the closed position as shown in FIGS. 1, 2 and 7. When gate 40 is in the closed position, it enables a merchandise container 7 move through discharge opening 11 and into receptacle 35, but prevents the container from being removed from receptacle 35 of dispenser 1 as seen FIGS. 1, 2 and 7. The container cannot be moved upwardly because of gate 40 nor in any other direction because of wires 36, 37 and 38 which form receptacle 35.

A customer desiring to remove a merchandise container 7 from dispenser 1, will grasp lifting ledge 47 and rotate gate 40 in a clockwise direction (FIGS. 1 and 2), which will move gate 40 from the closed position of FIG. 7 to the opened position of FIG. 8. In moving between the open and closed positions, tapered ends 44 of ribs 43 and tapered end 46 of tab portion 45, will move between the front most container 7 located in receptacle 35, and the adjacent container 7 still retained within storage chamber 4 of dispenser 1. These tapered surfaces facilitate the movement of gate 40 between the two adjacent containers 7. The force to move gate 40 is only sufficiently large to overcome the biasing effect of springs 67 and the movement of the gate between the adjacent containers. Upon the movement from the closed position of FIG. 7 toward the opened position of FIG. 8., finger 52 will rest upon surface 76 of channel 75, in which position the distal end 83 thereof will engage teeth 50 and produce a loud clicking sound indicating that a customer is opening the dispensing gate. However, when moving toward the closed position, of FIG. 8, finger 52, due to its loose mounting in circular recess 73 and channel 45, will move sufficiently away from teeth 50 to reduce or eliminate the clicking sound because of angled surfaces 76 and 77 of channel 75. However, if desired, finger 52 could engage teeth 50 in both directions of movement of gate 40 to produce a sound whether the gate is opening or closing without effecting the concept of this audio sound producing feature.

Upon gate 40 reaching the open position of FIG. 8, a customer merely removes an item 7 therefrom as shown by arrow A, afterwhich springs 67 will automatically move gate 40 from the open position of FIG. 8 to the closed position of FIG. 7. However, in accordance with one of the main features of the invention, when gate 40 is in the open position of FIG. 8, it sufficiently blocks discharge opening 11, preventing the adjacent container 7 from moving through opening 11 and into receptacle 35. This rearward adjacent container 7 cannot move forward into receptacle 35 until gate 40 has moved completely to the closed position of FIG. 7, which will then enable the container 7 to move forwardly into receptacle 35. This container 7 is trapped and retained in receptacle 35 by gate 40 as shown in FIG. 7, until the gate has been reopened to the position of FIG. 8. Thus, the customer must open and close the door each time he/she wishes to remove a container 7 from dispenser 1. This time delay has found to be sufficient to retard certain shoplifting activities where a customer will rapidly remove a number of the items for concealment in clothing or receptacle, unlawfully removing the merchandise from the store. Furthermore, the producing of the clicking sound upon movement of gate 40 will also serve as a deterrent to a shoplifter wishing to remove a plurality of containers 7 from the receptacle. If desired, an EAS tag (not shown) could be attached to each of the containers which would sound an alarm upon unauthorized passing through a secured gate at the exit of the store.

Thus the improved dispenser of the present invention provides a relatively simple, yet efficient device which permits the dispensing of items of merchandise, such as cylindrical shaped containers, in a controlled manner by providing a time delay between the dispensing of individual items by requiring a closure gate to be moved between open and closed positions each time an item is to be dispensed from the dispenser. Likewise, the dispenser preferably is formed of rigid wires which provides a housing or display rack in which the contents are easily seen by a perspective customer, enabling the contents stored therein to be recognized and the labels easily read on the container. Furthermore, various advertising materials can be placed on the entrance door which provides a convenient manner for loading the display housing with merchandise, yet prevents removal of the merchandise from the entrance opening once items have been placed in the housing.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A dispenser for items of merchandise comprising:

a housing for storing a plurality of the items, said housing having an entrance opening and a discharge opening for placing and removing said items into and from the housing, said housing further including a fixed immovable receptacle adjacent the discharge opening, said receptacle having spaced sides, a support bottom and an open top;

a one-way flexible member having a fixed end mounted on the housing adjacent the entrance opening and having a free end always projecting into the housing permitting insertion of the items into the housing through said entrance opening while preventing removal of said items from the housing through said entrance opening;

a gate moveably mounted on the receptacle at the discharge opening permitting removal of only one of the items at a time from the housing, said gate being moveable between a first position across at least a portion of the open top of the receptacle preventing removal of an item from the receptacle, and a second position across at least a portion of the discharge opening permitting removal of one of the items through the open top of the receptacle while preventing another item from entering the receptacle through the discharge opening when in the second position until the gate has returned to the first position, said gate having a trailing edge which moves downwardly between adjacent items when moving from the first position to the second position, and when in said second position the gate is out of supporting contact with the item supported by the receptacle.

2. The dispenser defined in claim 1 wherein the gate is an arcuate shaped member rotatably mounted on the receptacle adjacent the discharge opening for movement between the first and second positions.

3. The dispenser defined in claim 1 wherein the receptacle has a generally semi-cylindrical configuration.

4. A dispenser for items of merchandise comprising:

a housing for storing a plurality of the items, said housing having an entrance opening and a discharge opening for placing and removing said items into and from the housing;

an arcuate-shaped gate moveably rotatably mounted adjacent the discharge opening for movement between the first and second positions, said gate permitting removal of only one of the items at a time from the housing, said gate being moveable between the first position across at least a portion of the discharge opening preventing removal of any of the items from the housing, and the second position permitting removal of one of the items proximate the discharge opening while blocking removal of the other of said items from the housing until the gate has returned to the first position;

said gate being formed with a pair of ribs extending along an outer surface of the gate; and said ribs terminating in tapered ends to assist in moving past an adjacent item when the gate moves toward the second position.

5. A dispenser for items of merchandise comprising:

a housing for storing a plurality of the items, said housing having an entrance opening and a discharge opening for placing and removing said items into and from the housing;

a gate moveably mounted at the discharge opening permitting removal of only one of the items at a time from the housing, said gate being moveable between a first position across at least a portion of the discharge opening preventing removal of any of the items from the housing, and the second position permitting removal of one of the items proximate the discharge opening while blocking removal of the other of said items from the housing until the gate has returned to the first position; and a one-way flexible member having a first end fixedly mounted on the housing adjacent the entrance opening and having a free end always projecting into the housing permitting insertion of the items into the housing through said entrance opening while preventing removal of said items from the housing through said entrance opening.

6. The dispenser defined in claim 5 including a sound producing device activated upon the gate moving between the first and second positions.

7. The dispenser defined in claim 6 wherein the sound producing device includes a flexible finger engaged with a series of teeth movable with the gate.

8. The dispenser defined in claim 5 including a moveable door for selectively opening and closing the entrance opening of the housing.

9. The dispenser defined in claim 8 including a display holder mounted on the closure door for holding indicia pertaining to the items contained in the housing.

10. The dispenser defined in claim 9 wherein the display holder is a panel mounted on the closure door forming a pocket therewith for receiving the indicia; and in which the panel has transparent areas for viewing the indicia.

11. The dispenser defined in claim 5 wherein the housing is secured to a support structure.

12. The dispenser defined in claim 5 wherein the housing is a wire rack having a plurality of spaced wires enabling the items to be viewed when stored in the housing.

13. The dispenser defined in claim 5 wherein the housing has a generally U-shaped configuration with an upper portion sloped toward a curved web portion and a lower portion sloped from the web portion toward the discharge opening.

14. The dispenser defined in claim 13 wherein the upper and lower portions of the housing are generally rectangular in cross section and are formed by a plurality of spaced rigid metal wires.

15. A dispenser for items of merchandise comprising:

a housing for storing a plurality of the items, said housing having an entrance opening and a discharge opening for placing and removing said items into and from the housing;

a gate moveably mounted at the discharge opening permitting removal of only one of the items at a time from the housing, said gate being moveable between a first position across at least a portion of the discharge opening preventing removal of any of the items from the housing, and the second position permitting removal of one of the items proximate the discharge opening while blocking removal of the other of said items from the housing until the gate has returned to the first position, said gate being a one-piece member having an arcuate wall and a pair of side walls;

a pivot assembly operatively engaged with each of the side walls of the gate and mounted adjacent the discharge opening for pivotally mounting the gate; and a flexible finger attached to one of the pivot assemblies and engageable with a series of teeth formed along one of the side walls of the gate to produce an audible sound when the gate moves from the first toward the second position.

16. The dispenser defined in claim 15 in which the flexible finger is loosely mounted in the said one pivot assembly and moves out of substantial engagement with the series of teeth as the gate moves from the second position toward the first position to substantially reduce the audible sound produced thereby.

17. The dispenser defined in claim 16 wherein the flexible finger is formed with a rolled end loosely mounted in a recess formed in the said one pivot assembly.

18. A dispenser for items of merchandise comprising:

a housing for storing a plurality of the items, said housing having an entrance opening and a discharge opening for placing and removing said items into and from the housing, at least a position of the housing is formed of spaced wires;

a gate moveably mounted at the discharge opening permitting removal of only one of the items at a time from the housing, said gate being a one-piece member including an arcuate wall and a pair of side walls and moveable between a first position across at least a portion of the discharge opening preventing removal of any of the items from the housing and a second position permitting removal of one of the items proximate the discharge opening while blocking removal of the other of said items from the housing until the gate has returned to the first position;

a pivot assembly operatively engaged with each of the side walls of the gate and mounted adjacent the discharge opening for pivotally mounting the gate; and each of the pivot assemblies including a pair of hubs, each hub being formed with a groove for receiving a wire of the housing therein, said hubs being secured to each other and clamped to a respective wire of the housing for mounting the pivot assemblies on said housing.

19. The dispenser defined in claim 18 in which one of the pivot assemblies includes an end cap formed with an opening for receiving an end of a flexible sound producing finger; in which said end cap is mounted on one of the hubs; and in which a coil spring is located between said end cap and said one hub and operatively engages the gate to bias the gate toward the first position.

20. The dispenser defined in claim 18 wherein the end cap is formed with an annular rib which engages the gate to produce a slidable engagement surface therewith.

* * * * *